US010767245B2

(12) United States Patent
Takeda et al.

(10) Patent No.: US 10,767,245 B2
(45) Date of Patent: Sep. 8, 2020

(54) NICKEL MATERIAL AND METHOD FOR MANUFACTURING NICKEL MATERIAL

(71) Applicant: Nippon Steel Corporation, Tokyo (JP)

(72) Inventors: Kiyoko Takeda, Tokyo (JP); Masaaki Terunuma, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 9 days.

(21) Appl. No.: 16/339,774

(22) PCT Filed: Oct. 6, 2017

(86) PCT No.: PCT/JP2017/036554
§ 371 (c)(1),
(2) Date: Apr. 5, 2019

(87) PCT Pub. No.: WO2018/066709
PCT Pub. Date: Apr. 12, 2018

(65) Prior Publication Data

US 2020/0040431 A1 Feb. 6, 2020

(30) Foreign Application Priority Data

Oct. 7, 2016 (JP) ..... 2016-198796

(51) Int. Cl.
*C22C 19/03* (2006.01)
*C22C 1/02* (2006.01)
*C22F 1/10* (2006.01)

(52) U.S. Cl.
CPC ..... *C22C 19/03* (2013.01); *C22C 1/02* (2013.01); *C22F 1/10* (2013.01)

(58) Field of Classification Search
CPC ..... C22C 19/03; C22F 1/10
See application file for complete search history.

(56) References Cited

FOREIGN PATENT DOCUMENTS

| | | |
|---|---|---|
| CN | 102947474 A | 2/2013 |
| WO | 2008047869 A1 | 4/2008 |

OTHER PUBLICATIONS

Ohno, Satoru et al. "Effects of Hydrogen and Nitrogen on Blowhole Formation in pure Nickel at Arc Welding", Journal of the Japan Welding Society, 1979, vol. 48, No. 4, pp. 223-229.

*Primary Examiner* — Jessee R Roe
(74) *Attorney, Agent, or Firm* — Banner & Witcoff, Ltd.

(57) ABSTRACT

Provided is a nickel material having excellent corrosion resistance and high strength, and a method for manufacturing the nickel material. A nickel material has a chemical composition consisting of, in mass %, C: 0.001 to 0.20%, Si: 0.15% or less, Mn: 0.50% or less, P: 0.030% or less, S: 0.010% or less, Cu: 0.10% or less, Mg: 0.15% or less, Ti: 0.005 to 1.0%, Nb: 0.040 to 1.0%, Fe: 0.40% or less, sol. Al: 0.01 to 0.10%, an N: 0.0010 to 0.080%, with the balance being Ni and impurities, and satisfying Formula (1) and Formula (2).

$$0.030 \leq (45/48)Ti + (5/93)Nb - (1/14)N < 0.25 \quad (1)$$

$$0.030 < (3/48)Ti + (88/93)Nb - (1/12)C \quad (2)$$

A content (mass %) of a corresponding element is substituted for each element symbol in Formula (1) and Formula (2).

2 Claims, 1 Drawing Sheet

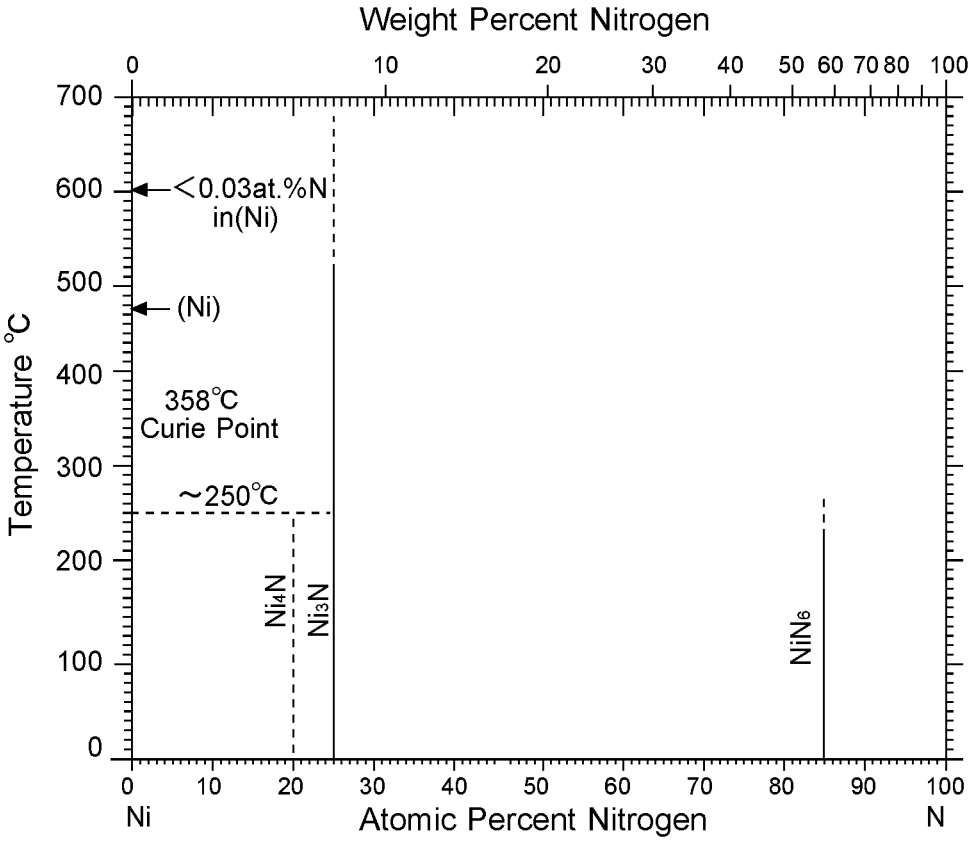
Weight Percent Nitrogen
0
10
20
30
40
50
60
70
80
100
700
600
500
400
300
200
100
0
Temperature °C
<0.03at.%N
in(Ni)
(Ni)
358°C
Curie Point
~250°C
Ni4N
Ni3N
NiN6
0
10
20
30
40
50
60
70
80
90
100
Ni
Atomic Percent Nitrogen
N
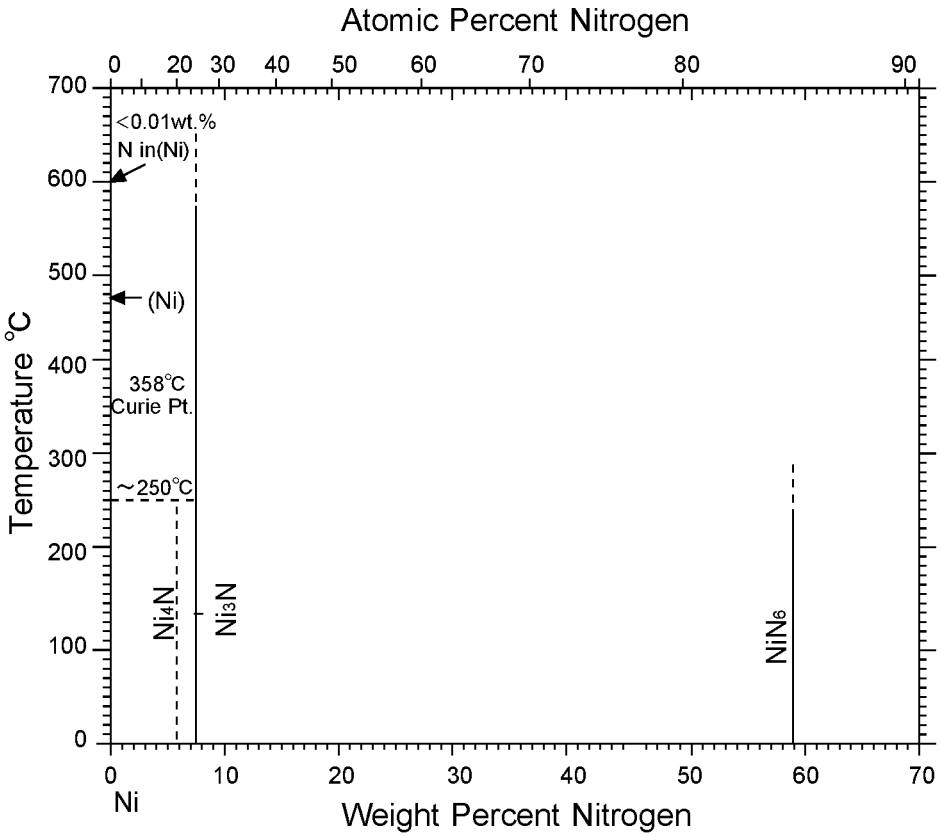
Atomic Percent Nitrogen
0
20
30
40
50
60
70
80
90
700
600
500
400
300
200
100
0
Temperature °C
<0.01wt.%
N in(Ni)
(Ni)
358°C
Curie Pt.
~250°C
Ni4N
Ni3N
NiN6
0
10
20
30
40
50
60
70
Ni
Weight Percent Nitrogen

NICKEL MATERIAL AND METHOD FOR MANUFACTURING NICKEL MATERIAL

TECHNICAL FIELD

The present invention relates to a nickel material and a method for manufacturing a nickel material, and more particularly relates to a nickel material for chemical plants and a method for manufacturing a nickel material for chemical plants.

BACKGROUND ART

Nickel has excellent corrosion resistance in alkaline conditions, and also exhibits excellent corrosion resistance under a high concentration chloride environment. Accordingly, a nickel material is utilized for forming a member (a seamless tube, a welded tube, a plate material or the like) in a variety of chemical plants such as facilities for making caustic soda or vinyl chloride.

In these facilities, nickel materials are utilized after being welded in many parts.

A nickel material includes carbon (C) as an impurity element. However, a solubility limit of C in nickel is low. Accordingly, if a nickel material is used for a long time under a high temperature, C precipitates in grain boundaries. Further, when a nickel material is welded, C may precipitate in grain boundaries due to the heat effect of welding. In these cases, there may be a case where a nickel material is embrittled, thus reducing corrosion resistance.

ASTM B161 "Standard Specification for Nickel Seamless Pipe and Tube" and ASTM B163 "Standard Specification for Seamless Nickel and Nickel Alloy Condenser and Heat-Exchanger Tubes" specify that the C content in a normal nickel material is 0.15% or less. The normal nickel material is designated as UNS No.: N02200 in the above-mentioned ASTM standard, for example. However, for the application of a nickel material used for a long time under a high temperature, a nickel material where the C content is further reduced has been put into use. The nickel material where the C content is further reduced is designated as UNS No.: N02201 in terms of the above-mentioned ASTM standard, for example. The C content in N02201 is 0.02% or less.

However, also in a nickel material having a low C content such as N02201, there may be a case where, in long-term use under a high temperature, C included in the nickel material as an impurity precipitates in grain boundaries (grain boundary precipitation), thus reducing corrosion resistance.

International Application Publication No. WO 2008/047869 (Patent Literature 1) discloses a technique for suppressing, in a nickel material, precipitation of C in grain boundaries under a high temperature.

A nickel material disclosed in Patent Literature 1 includes, in mass %, C: 0.003 to 0.20%, and one, two or more kinds of elements selected from a group consisting of Ti, Nb, V and Ta with a total amount of less than 1.0%, wherein $(12/48)Ti+(12/93)Nb+(12/51)V+(12/181)Ta-C\geq 0$ is satisfied, and the balance being Ni and impurities. In Patent Literature 1, Ti, Nb, V, Ta and the like are included in a nickel material, and C is stabilized in grains as a carbide. Patent Literature 1 describes that, with such a configuration, precipitation of C in grain boundaries under a high temperature can be suppressed.

CITATION LIST

Patent Literature

Patent Literature 1: International Application Publication No. WO 2008/047869

Non Patent Literature

Non Patent Literature 1: ASM INTERNATIONAL, Binary Alloy Phase Diagrams, 2nd Edition, vol. 2

Non Patent Literature 2: research paper written by Satoru Ohno et al. "Effects of Hydrogen and Nitrogen on Blowhole Formation in pure Nickel at Arc Welding", Journal of The Japan Welding Society, 1979, Volume 48, Issue 4, Pages 223 to 229

SUMMARY OF INVENTION

Technical Problem

However, there may be a case where a material disclosed in Patent Literature 1 does not have sufficient strength. In such a case, flaws are liable to be formed on a nickel material at the time of manufacturing or working the nickel material. Accordingly, a nickel material which is to be used under a high temperature environment as described above is required to have excellent corrosion resistance and high strength.

An objective of the present invention is to provide a nickel material having excellent corrosion resistance and high strength, and a method for manufacturing the nickel material.

Solution to Problem

A nickel material according to this embodiment has a chemical composition consisting of, in mass %, C: 0.001 to 0.20%, Si: 0.15% or less, Mn: 0.50% or less, P: 0.030% or less, S: 0.010% or less, Cu: 0.10% or less, Mg: 0.15% or less, Ti: 0.005 to 1.0%, Nb: 0.040 to 1.0%, Fe: 0.40% or less, sol. Al: 0.01 to 0.10%, and N: 0.0010 to 0.080%, with the balance being Ni and impurities, and satisfying Formula (1) and Formula (2), $$0.030\leq(45/48)Ti+(5/93)Nb-(1/14)N<0.25 \quad (1)$$

$$0.030<(3/48)Ti+(88/93)Nb-(1/12)C \quad (2)$$

where a content (mass %) of a corresponding element is substituted for each element symbol in Formula (1) and Formula (2).

It is preferable that a method for manufacturing the nickel material of this embodiment includes steps of: making molten metal by adding C, Si, Mn, P, S, Cu, Mg, Nb, Fe and Al such that a sol. Al content in the molten metal is 0.01% or more; forming a Ti nitride in the molten metal such that Ti is added to and dissolved in the molten metal where the sol. Al content is 0.01% or more, and thereafter that N is added to the molten metal; and manufacturing a nickel material having the chemical composition using the molten metal including the Ti nitride formed therein.

Advantageous Effects of Invention

A nickel material according to the present invention has excellent corrosion resistance and high strength.

BRIEF DESCRIPTION OF DRAWING

FIG. 1 is a phase diagram showing a solubility limit of N in Ni. FIG. 1 is described on page 1651 of ASM INTER- NATIONAL, Binary Alloy Phase Diagrams, 2nd Edition, vol. 2 (Non Patent Literature 1).

DESCRIPTION OF EMBODIMENT

Hereinafter, an embodiment of the present invention is described in detail. Hereinafter, "%" in relation to an element means "mass %".

Inventors of the present invention have made investigations on the corrosion resistance and the strength of a nickel material. As a result, the inventors of the present invention have made the following findings.

(A) Ti has a strong affinity for N so that Ti precipitates as a nitride at the time of solidification. A Ti nitride is stably present also during hot working, and makes crystal grains of a nickel material fine in the manufacturing process. Accordingly, the strength of the nickel material is increased. As long as formation of a carbide by Nb described later can be ensured, the whole amount of Ti may contribute to the formation of the nitride.

Nb may not independently precipitate as a nitride at the time of solidification. However, Nb is taken into Ti nitride, thus precipitating as a composite nitride of Ti and Nb. In the same manner as the Ti nitride, the composite nitride of Ti and Nb is stably present also during hot working, and makes crystal of a nickel material fine in the processing process. Accordingly, the strength of the nickel material is increased. Therefore, the amount of Nb which precipitates as a nitride is approximately 1/20 of the whole Nb content, and Nb precipitates in the form of a composite nitride of Ti and Nb.

Based on the above findings, the inventors of the present invention have derived the following Formula (1).

$$0.030 \leq (45/48)Ti + (5/93)Nb - (1/14)N < 0.25 \quad (1)$$

A content (mass %) of a corresponding element is substituted for each element symbol in Formula (1).

Formula (1) is a formula relating to formation amounts of nitrides (Ti nitride and composite nitride of Ti and Nb). When a Ti content, an Nb content, and an N content in a nickel material satisfy Formula (1), a sufficient amount of nitrides is formed so that crystal grains are made sufficiently fine. As a result, the strength of the nickel material can be increased.

(B) Ti and Nb are also elements which form thermodynamically stable carbides. Accordingly, surplus Ti and surplus Nb generated due to the above-mentioned formation of the nitride precipitate as carbides. These carbides precipitate in grains so that the amount of C dissolving in a nickel material (hereinafter also referred to as "dissolved C") is reduced. As a result, it is possible to reduce the amount of C which precipitates in grain boundaries due to long-term use under a high temperature, the effect of the heat generated at the time of welding or the like. Reducing the amount of C precipitation in grain boundaries using carbide precipitation is also referred to as C immobilization in grains hereinafter. When C is stabilized in grains, corrosion resistance is increased.

As described above, Ti and Nb are partially consumed as nitrides. Accordingly, to immobilize C in grains in a stable manner, surplus Ti and surplus Nb for precipitating carbides are required even after the formation of the nitride.

Based on the above findings, the inventors of the present invention have derived the following Formula (2).

$$0.030 < (3/48)Ti + (88/93)Nb - (1/12)C \quad (2)$$

A content (mass %) of a corresponding element is substituted for each element symbol in Formula (2).

Formula (2) is a formula relating to the formation amounts of carbides. When a Ti content, an Nb content and a C content satisfy Formula (2), carbides precipitate so that sufficient C immobilization in grains can be realized. As a result, corrosion resistance of the nickel material is increased.

(C) One example of the above-mentioned method for manufacturing a nickel material is as follows. Ti is an element which is easily oxidized. Accordingly, it is preferable that, in a nickel material manufacturing step, components excluding Ti and N be melted in advance, and the amount of oxygen in a nickel material be reduced in advance by Al deoxidation. Then, Ti is added to and dissolved in the molten metal where a sol. Al content is 0.01% or more and, thereafter, N is added to the molten metal. With such steps, Ti and N are bonded to each other and hence, a larger amount of Ti nitride is easily formed. Accordingly, manufacturing a nickel material having the above-mentioned chemical composition using this molten metal allows crystal grains to be made finer. As a result, the strength of the nickel material is further increased.

(D) As described above, N is bonded to Ti and Nb, thus forming nitrides and hence, N increases the strength of a nickel material by making crystal grains fine. When an N content is 0.0010 mass % or more, such an advantageous effect can be acquired. However, N is hard to be dissolved in a nickel material, which includes 99.0 mass % or more of Ni. Nitride nucleates and precipitates at the time of solidification. However, when N is not dissolved before solidification, N does not nucleate so that a nitride is prevented from being easily precipitated.

FIG. 1 is a phase diagram showing a solubility limit of N in Ni. FIG. 1 is described on page 1651 of ASM INTERNATIONAL, Binary Alloy Phase Diagrams, 2nd Edition, vol. 2 (Non Patent Literature 1). Referring to FIG. 1, a solubility limit of N in pure Ni is less than 0.01 mass % at 0 to 700° C.

Further, there is a description that an N content in pure Ni is 0.0005% in Table 1 on page 224 of a research paper written by Satoru Ohno et al. "Effects of Hydrogen and Nitrogen on Blowhole Formation in pure Nickel at Arc Welding", Journal of The Japan Welding Society, 1979, Volume 48, Issue 4 (Non Patent Literature 2).

As described above, an N content in a conventional nickel material is less than 0.0010 mass %. In this case, the above-mentioned advantageous effect of N cannot be acquired.

In view of the above, the inventors of the present invention have made various studies on a method for increasing the N content in a nickel material. As a result, the inventors of the present invention have found that including Al and Ti in a nickel material allows the N content in the nickel material to be increased. The reason is as follows. Including Al in a nickel material reduces the amount of oxygen in the nickel material by Al deoxidation. Ti is an easily oxidizable element. However, in a nickel material where the amount of oxygen is reduced, Ti and N are bonded to each other so that a larger amount of Ti nitride is formed compared to a case where a nickel material does not include Al. Accordingly, including N in a nickel material as a Ti nitride allows an N content in the nickel material to be increased.

It is preferable that, in a nickel material manufacturing step, components excluding Ti and N be melted in advance, and the amount of oxygen in the molten metal be reduced in advance by Al deoxidation. Then, Ti is added to and dissolved in the molten metal where the sol. Al content is 0.01% or more and, thereafter, N is added to the molten metal. With such steps, a larger amount of Ti nitride is easily formed. Accordingly, an N content in the nickel material is further increased. Therefore, manufacturing a nickel material having the above-mentioned chemical composition using this molten metal allows crystal grains to be made finer. As a result, the strength of the nickel material is further increased.

The nickel material of this embodiment which is completed based on the above-mentioned findings has a chemical composition consisting of, in mass %, C: 0.001 to 0.20%, Si: 0.15% or less, Mn: 0.50% or less, P: 0.030% or less, S: 0.010% or less, Cu: 0.10% or less, Mg: 0.15% or less, Ti: 0.005 to 1.0%, Nb: 0.040 to 1.0%, Fe: 0.40% or less, sol. Al: 0.01 to 0.10%, and N: 0.0010 to 0.080%, with the balance being Ni and impurities, and satisfying Formula (1) and Formula (2).

$$0.030 \leq (45/48)Ti + (5/93)Nb - (1/14)N < 0.25 \quad (1)$$

$$0.030 < (3/48)Ti + (88/93)Nb - (1/12)C \quad (2)$$

A content (mass %) of a corresponding element is substituted for each element symbol in Formula (1) and Formula (2).

It is preferable that the method for manufacturing the nickel material of this embodiment include steps of: making molten metal by adding C, Si, Mn, P, S, Cu, Mg, Nb, Fe and Al such that a sol. Al content in the molten metal is 0.01% or more; forming a Ti nitride in the molten metal such that Ti is added to and dissolved in the molten metal where the sol. Al content is 0.01% or more, and thereafter that N is added to the molten metal; and manufacturing a nickel material having the chemical composition using the molten metal including the Ti nitride formed therein.

Manufacturing a nickel material using the above-mentioned manufacturing method allows a larger amount of Ti nitride to be precipitated. In other words, a larger amount of nitride is formed so that crystal grains are made finer. As a result, the strength of the nickel material can be further increased.

Hereinafter, the nickel material of this embodiment is described in detail. Unless otherwise specified, "%" in relation to an element means mass %.

[Chemical Composition]

The chemical composition of the nickel material of this embodiment includes the following elements.

C: 0.001 to 0.20%

Carbon (C) increases the strength of a nickel material. In this embodiment, the strength of a nickel material is acquired by making crystal grains fine. Accordingly, it is not necessary to particularly specify the lower limit of the C content. When a C content is less than 0.001%, C precipitation in grain boundaries does not cause any problem. However, in the case where a C content is excessively high, even when C is stabilized in grains by Ti and Nb, dissolved C remains present without being stabilized in grains. Accordingly, at the time of using a nickel material, the amount of C precipitation in grain boundaries is increased and hence, corrosion resistance of the nickel material is reduced. Therefore, the C content is 0.001 to 0.20%. The upper limit of the C content is preferably 0.200%, is more preferably 0.100%, and is further preferably 0.020%.

Si: 0.15% or Less

Silicon (Si) is an impurity. Si forms inclusions. The inclusions reduce toughness of a nickel material. Accordingly, a Si content is 0.15% or less. The upper limit of the Si content is preferably 0.10%, and is more preferably 0.08%. It is preferable to set the Si content as low as possible. In consideration of refining costs, the lower limit of the Si content is 0.01%, for example.

Mn: 0.50% or Less

Manganese (Mn) is an impurity. Mn is bonded to S, thus forming MnS and hence, Mn reduces corrosion resistance of a nickel material. MnS also reduces weldability. Accordingly, a Mn content is 0.50% or less. The upper limit of the Mn content is preferably 0.30%, and is more preferably 0.20%. It is preferable to set the Mn content as low as possible. In consideration of refining costs, the lower limit of the Mn content is 0.05%, for example.

P: 0.030% or Less

Phosphorus (P) is an impurity. P segregates in grain boundaries at the time of weld solidification, thus increasing susceptibility to cracks caused by embrittlement of a heat affected zone. Accordingly, a P content is 0.030% or less. The upper limit of the P content is preferably 0.020%, and is more preferably 0.010%. It is preferable to set the P content as low as possible. In consideration of refining costs, the lower limit of the P content is 0.001%, for example.

S: 0.010% or Less

Sulfur (S) is an impurity. In the same manner as P, S segregates in grain boundaries at the time of weld solidification, thus increasing susceptibility to embrittlement of a heat affected zone. S further forms MnS, thus reducing corrosion resistance of a nickel material. Accordingly, an S content is 0.010% or less. The upper limit of the S content is preferably 0.0100%, is more preferably 0.0050%, and is further preferably 0.0020%. It is preferable to set the S content as low as possible. In consideration of refining costs, the lower limit of the S content is 0.002%, for example.

Cu: 0.10% or Less

Copper (Cu) is an impurity. Cu reduces corrosion resistance of a nickel material. Accordingly, a Cu content is 0.10% or less. The upper limit of the Cu content is preferably 0.05%, and is more preferably 0.02%. It is preferable to set the Cu content as low as possible. In consideration of refining costs, the lower limit of the Cu content is 0.003%, for example.

Mg: 0.15% or Less

Magnesium (Mg) is an impurity. Mg reduces corrosion resistance of a nickel material. Accordingly, an Mg content is 0.15% or less. The upper limit of the Mg content is preferably 0.150%, is more preferably 0.100%, and is further preferably 0.050%. It is preferable to set the Mg content as low as possible. In consideration of refining costs, the lower limit of the Mg content is 0.01%, for example.

Ti: 0.005 to 1.0%

Titanium (Ti) forms nitrides, thus making crystal grains of a nickel material fine. As a result, the strength of the nickel material is increased. The affinity of Ti for N is larger than the affinity of Ti for Nb. Accordingly, even when Ti coexists with Nb, Ti preferentially bonds with N, thus forming a nitride. Therefore, it is preferable that a Ti content be sufficient relative to an N content. Further, surplus Ti after the formation of the nitride forms a carbide, thus reducing the amount of dissolved C. As a result, C is stabilized in grains so that corrosion resistance of the nickel material is increased. An excessively low Ti content prevents the advantageous effect from being acquired. All amount of Ti may be used for forming the nitride. On the other hand, an excessively high Ti content reduces hot workability of the nickel material and hence, cracks are generated during rolling. Accordingly, a Ti content is 0.005 to 1.0%. The lower limit of the Ti content is preferably 0.015%, and is more preferably 0.050%. The upper limit of the Ti content is preferably 1.000%, is more preferably 0.300%, and is further preferably 0.200%.

Nb: 0.040 to 1.0%

In the same manner as Ti, niobium (Nb) forms nitrides, thus making crystal grains fine and hence, niobium increases the strength of a nickel material. For the formation of the nitride, a part but not all of Nb is utilized. For example, for the formation of the nitride, approximately 1/20 of the whole amount of Nb is used. Further, surplus Nb after the formation of the nitride forms a carbide, thus reducing the amount of dissolved C (C immobilization in grains). As a result, corrosion resistance is increased. An excessively low Nb content prevents these advantageous effects from being acquired. On the other hand, an excessively high Nb content reduces hot workability of a nickel material. Accordingly, the Nb content is 0.040 to 1.0%. The lower limit of the Nb content is preferably 0.10%, and is more preferably 0.20%. The upper limit of the Nb content is preferably 1.000%, is more preferably 0.500%, and is further preferably 0.300%.

Fe: 0.40% or Less

Iron (Fe) is an impurity. Fe reduces corrosion resistance of a nickel material. Accordingly, a Fe content is 0.40% or less. The upper limit of the Fe content is preferably 0.20%, and is more preferably 0.15%. It is preferable to set the Fe content as low as possible. In consideration of refining costs, the lower limit of the Fe content is 0.02%, for example.

sol. Al: 0.01 to 0.10%

Aluminum (Al) deoxidizes a nickel material. The above-mentioned Ti is an easily oxidizable element. Accordingly, as described later, it is preferable that, in a nickel material manufacturing step, molten metal be deoxidized by Al before Ti and N are added to the molten metal. Then, Ti and N are added to the molten metal where the sol. Al content is 0.01% or more. In this case, Ti is not easily bonded to O, but is easily bonded to N so that a larger amount of Ti nitride is formed. As a result, crystal grains are made finer and hence, the strength of the nickel material can be further increased. On the other hand, Al forms oxides, thus reducing cleanliness of the nickel material, also causing a reduction in workability and ductility of the nickel material. Accordingly, the sol. Al content is 0.01 to 0.10%. The lower limit of the sol. Al content is preferably 0.0100%, and is more preferably 0.0120%. The lower limit of the sol. Al content is more preferably 0.0150%, and is further preferably 0.0200%. The upper limit of the sol. Al content is preferably 0.1000%, is more preferably 0.0800%, and is further preferably 0.0500%.

N: 0.0010 to 0.080%

Nitrogen (N) is bonded to Ti and Nb, thus forming nitrides and hence, nitrogen increases the strength of a nickel material by making crystal grains fine. When an N content is 0.0010% or more, such an advantageous effect can be acquired. However, N is prevented from being easily dissolved in a nickel material which includes 90.0 mass % or more of Ni. Nitride precipitates at the time of solidification. However, when N is not dissolved before solidification, a nitride is prevented from being easily precipitated. An N content in a conventional nickel material is less than 0.0010%. In this case, the above-mentioned advantageous effect cannot be acquired. In this embodiment, Al and Ti are included in a nickel material. Including Al and Ti in a nickel material allows an N content in the nickel material to be increased. The reason is as follows. Including Al in a nickel material reduces the amount of oxygen in the nickel material by Al deoxidation. Ti is an element, which is easily oxidized. However, in a nickel material where the amount of oxygen is reduced, Ti is dissolved without being oxidized so that Ti is easily bonded to N whereby a larger amount of Ti nitride is formed compared to a case where a nickel material does not include Al. Accordingly, including N in a nickel material as a Ti nitride allows an N content in the nickel material to be increased.

On the other hand, when an N content is excessively high, N is bonded to Ti and Nb, thus excessively forming nitrides and hence, Ti and Nb are consumed. As a result, C immobilization in grains due to a carbide is suppressed and hence, dissolved C remains. As a result, corrosion resistance is reduced when a nickel material is in use. Accordingly, an N content is 0.0010 to 0.080%. The lower limit of the N content is preferably 0.0030%, is more preferably 0.0050%, and is further preferably more than 0.0100%. The upper limit of the N content is preferably 0.0800%, and is more preferably 0.0150%.

The balance of the chemical composition of the nickel material according to this embodiment consists of Ni and impurities. In this embodiment, impurities mean a material which is mixed into a nickel material from ore or scrap as a raw material, a manufacturing environment or the like in industrially manufacturing a nickel material, and which is allowed within a range where the impurities do not adversely affect the nickel material of this embodiment.

Impurities include cobalt (Co), molybdenum (Mo), oxygen (O), and tin (Sn), for example. These impurities may be 0%. A Co content is 0.010% or less. A Mo content is 0.010% or less. An 0 content is 0.0020% or less. A Sn content is 0.030% or less. The content of these impurities falls within the above-mentioned range in the normal manufacturing process described later.

[Formula (1)]

A chemical composition of the nickel material of this embodiment also satisfies Formula (1).

$$0.030 \leq (45/48)Ti + (5/93)Nb - (1/14)N < 0.25 \quad (1)$$

A content (mass %) of a corresponding element is substituted for each element symbol in Formula (1).

F1 is defined as $(45/48)Ti+(5/93)Nb-(1/14)N$ ($F1=(45/48)Ti+(5/93)Nb-(1/14)N$). F1 is an index of a formation amount of nitride. When F1 is less than 0.030, nitrides are not sufficiently formed so that crystal grains of a nickel material are not made sufficiently fine. As a result, the strength of the nickel material is reduced. On the other hand, when F1 is 0.25 or more, nitrides are excessively formed so that hot workability of a nickel material is reduced whereby cracks are generated during rolling. Accordingly, F1 is a value which falls within the range of 0.030 or more to less than 0.25 ($0.030 \leq F1 < 0.25$). The lower limit of F1 is preferably 0.035. The upper limit of F1 is preferably 0.15.

[Formula (2)]

The chemical composition of the nickel material of this embodiment also satisfies Formula (2).

$$0.030 < (3/48)Ti + (88/93)Nb - (1/12)C \quad (2)$$

A content (mass %) of a corresponding element is substituted for each element symbol in Formula (2).

F2 is defined as $(3/48)Ti+(88/93)Nb-(1/12)C$ ($F2=(3/48)Ti+(88/93)Nb-(1/12)C$). F2 is an index of the amount of C immobilization in grains. When F2 is 0.030 or less, carbides are not sufficiently formed. In this case, C immobilization in grains is not sufficient so that the amount of dissolved C in the nickel material remains high. Accordingly, C precipitates in grain boundaries due to long-term usage under a high temperature, the effect of the heat generated at the time of welding or the like and hence, corrosion resistance is reduced. Accordingly, F2 is a value less than 0.030 (0.030<F2). The upper limit of F2 is not particularly limited. However, taking into account the above-mentioned chemical composition, one example of the upper limit is 0.28.

[Manufacturing Method]

The nickel material of this embodiment is manufactured by any of various manufacturing methods. Hereinafter, as one example of the manufacturing method, a method for manufacturing a nickel material in the form of a tube is described.

The method for manufacturing a nickel material of this embodiment includes a molten metal manufacturing step, and a nickel material manufacturing step.

[Molten Metal Making Step]

In the molten metal making step, molten metal having the above-mentioned chemical composition is made. It is sufficient for the molten metal to be made by a well-known melting method. For example, the well-known melting method may be melting performed using an electric furnace, an AOD (Argon Oxygen Decarburization) furnace, a VOD (Vacuum Oxygen Decarburization) furnace, a VIM (Vacuum Induction Melting) furnace or the like.

[Nickel Material Manufacturing Step]

In the nickel material manufacturing step, the above-mentioned nickel material is manufactured using the molten metal. The nickel material manufacturing step includes, for example, a casting step, a hot working step, and a heat treatment step. Hereinafter, as one example, the description is made with respect to a nickel material manufacturing step in the case where a nickel material is in the form of a tube.

[Casting Step]

A starting material is manufactured using the above-mentioned molten metal. For example, the starting material may be an ingot manufactured by a well-known ingot-making process, or a cast piece manufactured by a well-known continuous casting process.

[Hot Working Step]

A hollow billet is manufactured from the manufactured starting material (ingot or cast piece). The hollow billet is manufactured by mechanical processing or vertical piercing, for example. The hot-extrusion process is performed on the hollow billet. The hot-extrusion process may be the Ugine-Sejournet extrusion method, for example. By performing the above-mentioned steps, a nickel material in the form of a tube is manufactured. A nickel material in the form of a tube may also be manufactured by hot working other than the hot-extrusion process.

Cold working such as cold rolling and/or cold-drawing may also be performed on the nickel material in the form of a tube which is subjected to the hot working.

[Heat Treatment Step]

A heat treatment step is performed when necessary on the nickel material in the form of a tube which is subjected to the hot working, or on the nickel material in the form of a tube which is also subjected to the cold working after the hot working. In the heat treatment step, the nickel material in the form of a tube is heated and held at 750 to 1100° C. and, thereafter, is quenched with water, air or the like. With such steps, a Ti carbide and an Nb carbide precipitate so that C immobilization in grains is promoted. A preferred temperature for the heat treatment falls within the range of 750 to 850° C. In this case, grain growth in the heat treatment can be suppressed. The heat treatment temperature is decided depending on the balance with strength.

One example of the method for manufacturing a nickel material has been described heretofore by taking the nickel material in the form of a tube as an example. However, the nickel material is not limited to be in the form of a tube. The nickel material may be in the form of a plate material, or may be in the form of a wire rod. Accordingly, the hot working step is not limited to the hot-extrusion process. For example, a nickel material may be manufactured by hot rolling or hot forging. Alternatively, as described above, the heat treatment step may either be performed or not be performed.

The nickel material manufactured by the above-mentioned manufacturing method has excellent corrosion resistance and high strength.

[Preferred Molten Metal Making Step]

It is preferable that the molten metal making step includes a specific-element-including molten metal step and a Ti and N addition step.

As described above, N is bonded to Ti and Nb, thus forming nitrides and hence, N increases the strength of a nickel material by making crystal grains fine. When an N content is 0.0010% or more, such an advantageous effect can be acquired. However, N is prevented from being easily dissolved in a nickel material. An N content in a conventional nickel material is less than 0.0010%. In this case, the above-mentioned advantageous effect of N cannot be acquired. Accordingly, Al and Ti are included in a nickel material. Including Al in the nickel material reduces the amount of oxygen in the nickel material by Al deoxidation. Ti is an easily oxidizable element. However, in a nickel material where the amount of oxygen is reduced, Ti is not oxidized so that Ti is easily bonded to N whereby a larger amount of Ti nitride is formed compared to a case where a nickel material does not include Al. Accordingly, including N in a nickel material as a Ti nitride allows an N content in the nickel material to be increased.

It is preferable that, in a nickel material manufacturing step, components excluding Ti and N be melted in advance, and the amount of oxygen in the molten metal be reduced in advance by Al deoxidation. Then, Ti is added to and dissolved in the molten metal where the sol. Al content is 0.01% or more and, thereafter, N is added to the molten metal. With such steps, a larger amount of Ti nitride is easily formed. Accordingly, an N content in the nickel material is further increased. Therefore, manufacturing the nickel material, having the above-mentioned chemical composition, using this molten metal allows crystal grains to be made finer. As a result, the strength of the nickel material is further increased.

[Specific-Element-Including Molten Metal Step]

In this case, first, molten metal, to which C, Si, Mn, P, S, Cu, Mg, Nb, Fe and Al of the above-mentioned chemical composition are added, is manufactured. At this point of operation, Al is included in the molten metal so that deoxidation is performed. In this step, the sol. Al content in the molten metal is 0.01% or more.

[Ti and N Addition Step]

Next, Ti is added to and dissolved in the molten metal where the sol. Al content is 0.01% or more and, thereafter, N is added to the molten metal so as to form a Ti nitride in the molten metal. For example, N is added to the molten metal by pressurizing and sealing an N gas. Before Ti is added to the molten metal, the molten metal is subjected to Al deoxidation and hence, an O content in the molten metal is low. Accordingly, Ti added to the molten metal is more easily bonded to N than to O. Therefore, a larger amount of Ti nitride is formed.

The above-mentioned nickel material manufacturing step is performed using the molten metal on which the Ti and N addition step is performed. In this case, a larger amount of Ti nitride is formed in a starting material and hence, crystal grains of the manufactured nickel material are made finer. Accordingly, the strength of the nickel material is further increased.

EXAMPLE

For test number 1 to test number 14 shown in Table 1, components excluding Ti and N were subjected to vacuum-melting and, then, deoxidized with Al. Ti was added to the deoxidized molten metal and, then, an N gas was pressurized and sealed so as to form a Ti nitride. A 30 kg ingot was manufactured from the molten metal including the Ti nitride formed therein. In test number 15 shown in Table 1, components excluding only Al were subjected to vacuum-melting and, thereafter, were deoxidized with Al. In other words, Ti and N were added to molten metal before the molten metal is deoxidized with Al. Test number 5 has components which correspond to JIS H4552 NW2201. In test number 8, molten metal includes N. However, the Ti nitride was excessively precipitated and hence, cracks were generated at the time of hot forging whereby processing on a plate material was not allowed.

TABLE 1

| TEST | CHEMICAL COMPOSITION (MASS %, BALANCE BEING Ni AND IMPURITIES) | | | | | | | | | | | | | | | | | |
|---|---|---|---|---|---|---|---|---|---|---|---|---|---|---|---|---|---|---|
| NUMBER | C | Si | Mn | P | S | Cu | Mg | Ti | Nb | Fe | sol. Al | N | Co | Mo | O | Sn | F1 | F2 |
| 1 | 0.008 | 0.09 | 0.15 | 0.002 | 0.0006 | <0.01 | 0.008 | 0.015 | 0.308 | 0.06 | 0.0132 | 0.0051 | 0.008 | 0.008 | 0.0008 | 0.003 | 0.030 | 0.292 |
| 2 | 0.012 | 0.10 | 0.16 | 0.002 | 0.0005 | <0.01 | 0.009 | 0.051 | 0.081 | 0.03 | 0.0125 | 0.0156 | 0.003 | 0.003 | 0.0012 | 0.001 | 0.051 | 0.079 |
| 3 | 0.014 | 0.10 | 0.15 | 0.003 | 0.0002 | <0.01 | 0.028 | 0.033 | 0.154 | 0.05 | 0.0126 | 0.0112 | 0.005 | 0.001 | 0.0011 | 0.007 | 0.038 | 0.147 |
| 4 | 0.016 | 0.11 | 0.14 | 0.002 | 0.0003 | <0.01 | 0.009 | 0.154 | 0.297 | 0.04 | 0.0103 | 0.0028 | 0.001 | 0.002 | 0.0010 | 0.002 | 0.160 | 0.289 |
| 5 | 0.015 | 0.12 | 0.14 | 0.003 | 0.0005 | <0.01 | 0.036 | 0.004 | 0.011 | 0.04 | 0.0116 | 0.0001 | 0.002 | 0.001 | 0.0011 | 0.003 | 0.004 | 0.009 |
| 6 | 0.015 | 0.10 | 0.15 | 0.004 | 0.0007 | <0.01 | 0.008 | 0.265 | 0.004 | 0.04 | 0.0102 | 0.0129 | 0.006 | 0.008 | 0.0009 | 0.001 | 0.248 | 0.019 |
| 7 | 0.009 | 0.08 | 0.15 | 0.003 | 0.0006 | <0.01 | 0.112 | 0.001 | 0.786 | 0.06 | 0.0114 | 0.0015 | 0.008 | 0.002 | 0.0012 | 0.008 | 0.043 | 0.743 |
| 8 | 0.015 | 0.11 | 0.17 | 0.004 | 0.0002 | <0.01 | 0.125 | 0.342 | 0.277 | 0.05 | 0.0115 | 0.0798 | 0.002 | 0.001 | 0.0014 | 0.002 | 0.330 | 0.282 |
| 9 | 0.014 | 0.10 | 0.15 | 0.003 | 0.0005 | <0.01 | 0.081 | 0.027 | 0.024 | 0.04 | 0.0127 | 0.0006 | 0.003 | 0.002 | 0.0013 | 0.001 | 0.027 | 0.023 |
| 10 | 0.019 | 0.09 | 0.16 | 0.002 | 0.0004 | <0.01 | 0.008 | 0.034 | 0.045 | 0.03 | 0.0131 | 0.0008 | 0.009 | 0.003 | 0.0016 | 0.003 | 0.034 | 0.043 |
| 11 | 0.014 | 0.12 | 0.15 | 0.003 | 0.0008 | <0.01 | 0.031 | 0.045 | 0.035 | 0.06 | 0.0122 | 0.0010 | 0.002 | 0.005 | 0.0009 | 0.002 | 0.044 | 0.035 |
| 12 | 0.006 | 0.10 | 0.13 | 0.003 | 0.0004 | <0.01 | 0.009 | 0.008 | 0.099 | 0.05 | 0.0118 | 0.0021 | 0.001 | 0.002 | 0.0012 | 0.001 | 0.013 | 0.094 |
| 13 | 0.137 | 0.10 | 0.15 | 0.004 | 0.0007 | <0.01 | 0.008 | 0.032 | 0.040 | 0.04 | 0.0102 | 0.0012 | 0.003 | 0.007 | 0.0011 | 0.003 | 0.032 | 0.028 |
| 14 | 0.010 | 0.10 | 0.12 | 0.002 | 0.0006 | <0.01 | 0.009 | 0.015 | 0.181 | 0.05 | 0.0015 | 0.0003 | 0.007 | 0.001 | 0.0010 | 0.002 | 0.024 | 0.171 |
| 15 | 0.016 | 0.08 | 0.14 | 0.002 | 0.0005 | <0.01 | 0.009 | 0.052 | 0.055 | 0.04 | 0.0103 | 0.0011 | 0.005 | 0.002 | 0.0002 | 0.001 | 0.052 | 0.054 |

Each ingot was subjected to hot forging at 1100° C. and, thereafter, was subjected to hot rolling at 1100° C. so as to manufacture a plate material having a thickness of 20 mm. Cold rolling was further performed on the plate materials so as to manufacture a plurality of plate materials having a thickness of 15 mm, a width of 80 mm, and a length of 200 mm. The respective plate materials were subjected to stress relieving annealing treatment at 800° C. for 30 minutes. The plate materials, on which the stress relieving annealing treatment was performed, were quenched (cooled with water). The nickel materials (plate materials) of the respective test numbers were manufactured through the above-mentioned manufacturing steps.

[Evaluation Test]

The following evaluation test was performed using the manufactured nickel materials of the respective test numbers.

[Tensile Strength (TS) Test]

The No. 5 tensile test specimen based on JIS Z2201 was sampled from a center portion of the manufactured nickel material (plate material) in the plate thickness. A tensile test was performed in the atmosphere at a normal temperature (25° C.) using the tensile test specimens.

The tensile strength in test number 5 was used as the reference (100%). When the tensile strength of each test number was 110% or more of the tensile strength in test number 5, it was determined that a nickel material has excellent strength (excellent) (indicated by "A" in Table 2). When tensile strength was 105 to less than 110% of the tensile strength in test number 5, it was determined that a nickel material has sufficient strength (good) (indicated by "B" in Table 2). On the other hand, when tensile strength was less than 105% of the tensile strength in test number 5, it was determined that a nickel material has low strength (failure) (indicated by "F" in Table 2).

TABLE 2

| TEST NUMBER | ORDER OF ADDITION OF Al | F1 | F2 | TENSILE STRENGTH TS | CORROSION RESISTANCE |
|---|---|---|---|---|---|
| 1 | Al→Ti, N | 0.030 | 0.292 | A | A |
| 2 | Al→Ti, N | 0.051 | 0.079 | A | A |
| 3 | Al→Ti, N | 0.038 | 0.147 | A | A |
| 4 | Al→Ti, N | 0.160 | 0.289 | A | A |
| 5 | Al→Ti, N | 0.004 | 0.009 | — | F |
| 6 | Al→Ti, N | 0.248 | 0.019 | A | F |
| 7 | Al→Ti, N | 0.043 | 0.743 | F | A |

TABLE 2-continued

| TEST NUMBER | ORDER OF ADDITION OF Al | F1 | F2 | TENSILE STRENGTH TS | CORROSION RESISTANCE |
|---|---|---|---|---|---|
| 8 | Al→Ti, N | 0.330 | 0.282 | PLATE MATERIAL COULD NOT BE MANUFACTURED DUE TO HOT FORGING CRACKS | |
| 9 | Al→Ti, N | 0.027 | 0.023 | F | F |
| 10 | Al→Ti, N | 0.034 | 0.043 | F | A |
| 11 | Al→Ti, N | 0.044 | 0.035 | A | F |
| 12 | Al→Ti, N | 0.013 | 0.094 | F | A |
| 13 | Al→Ti, N | 0.032 | 0.028 | A | F |
| 14 | Al→Ti, N | 0.024 | 0.171 | F | A |
| 15 | Ti, N→Al | 0.052 | 0.054 | B | A |

The values of F1 and F2 of nickel materials of respective test numbers are shown in column "F1" and column "F2" in Table 1 and Table 2.

[Evaluation of Corrosion Resistance]

A corrosion resistance evaluation test was performed using manufactured nickel materials of respective test numbers. In the corrosion resistance evaluation test, presence or absence of C precipitation in grain boundaries was observed using an optical electron microscope so as to evaluate corrosion resistance. To be more specific, simulating a welding heat affected zone, sensitization heat treatment was performed at 600° C. for 166 hours on a test specimen on which final heat treatment was performed. A test specimen having a thickness of 15 mm, a width of 20 mm, and a length of 10 mm was sampled from the plate material on which the sensitization heat treatment was performed. The lengthwise direction of the test specimen extends parallel to the lengthwise direction of the plate material. The test specimen was embedded into an epoxy resin, and a surface of 15 mm×20 mm was polished. The method of oxalic acid etching test described in JIS G0571 was applied to the test specimens. Electrolytic etching was performed for 90 seconds in 10% oxalic acid solution with an electric current 1 A/cm$^2$. With respect to the test specimens, on which the electrolytic etching was performed, presence or absence of C precipitation in grain boundaries was observed using an optical electron microscope at 500-fold magnification.

When intergranular corrosion caused by carbide precipitation has a stepped microstructure, C is stabilized in grains and hence, it was evaluated that the test specimen has excellent corrosion resistance (indicated by "A" in Table 2). On the other hand, when intergranular corrosion caused by carbide precipitation has a mixed structure or a groove-like microstructure, C is not stabilized in grains and hence, it was evaluated that the test specimen has low corrosion resistance (indicated by "F" in Table 2).

[Test Result]

Test results are shown in Table 2.

Referring to Table 1 and Table 2, in test number 1 to test number 4 and test number 15, contents of respective elements in the nickel materials were appropriate, and the chemical composition satisfied Formula (1) and Formula (2). As a result, the nickel materials had high tensile strength. In these test numbers, the nickel materials also showed excellent corrosion resistance.

Further, in test number 1 to test number 4, molten metal was deoxidized with Al and, thereafter, Ti was added to the molten metal. Accordingly, tensile strength in test number 1 to test number 4 was higher than that in test number 15.

On the other hand, in test number 5, a Ti content, an Nb content and an N content were low so that F1 and F2 did not respectively satisfy Formula (1) or Formula (2). Accordingly, a carbide (precipitation) was observed in grain boundaries and hence, the nickel material had low corrosion resistance.

In test number 6, an Nb content was excessively low and hence, F2 was 0.030 or less. Accordingly, a carbide was observed in grain boundaries and hence, the nickel material had low corrosion resistance.

In test number 7, a Ti content was excessively low. As a result, the nickel material had low tensile strength.

In test number 8, F1 was 0.25 or more. Accordingly, hot workability of the nickel material was reduced. As a result, hot forging cracks were generated and hence, manufacturing of a plate material was not allowed.

In test number 9 an Nb content and an N content were excessively low. Further, F1 and F2 did not respectively satisfy Formula (1) or Formula (2). Accordingly, the nickel material had low tensile strength. Further, a carbide was observed in grain boundaries and hence, the nickel material had low corrosion resistance.

In test number 10, an N content was excessively low. Accordingly, the nickel material had low tensile strength.

In test number 11, an Nb content was excessively low. Accordingly, a carbide was observed in grain boundaries and hence, the nickel material had low corrosion resistance.

In test number 12, F1 did not satisfy Formula (1). Accordingly, the nickel material had low tensile strength.

In test number 13, F2 did not satisfy Formula (2). Accordingly, a carbide was observed in grain boundaries and hence, the nickel material had low corrosion resistance.

In test number 14, an addition amount of Al is small so that the nickel material was not sufficiently deoxidized. Although Ti was added, N is not stabilized as TiN and hence, an N content was low. Accordingly, F1 was not satisfied and hence, the nickel material had low tensile strength.

The embodiment of the present invention has been described heretofore. However, the above-mentioned embodiment is given only for the sake of example of an embodiment for carrying out the present invention. Accordingly, the present invention is not limited to the above-mentioned embodiment, and the above-mentioned embodiment can be desirably modified without departing from the gist of the present invention.

The invention claimed is:

1. A nickel material comprising a chemical composition consisting of, in mass %, C: 0.001 to 0.20%,
Si: 0.15% or less,
Mn: 0.50% or less,
P: 0.030% or less,
S: 0.010% or less,
Cu: 0.10% or less,
Mg: 0.15% or less,
Ti: 0.005 to 1.0%,
Nb: 0.040 to 1.0%,
Fe: 0.40% or less,
sol. Al: 0.01 to 0.10%, and
N: 0.0010 to 0.080%, with the balance being Ni and impurities, and satisfying Formula (1) and Formula (2):

$$0.030 \leq (45/48)Ti + (5/93)Nb - (1/14)N < 0.25 \quad (1)$$

$$0.030 < (3/48)Ti + (88/93)Nb - (1/12)C \quad (2)$$

where a content (mass %) of a corresponding element is substituted for each element symbol in Formula (1) and Formula (2).

2. A method for manufacturing the nickel material according to claim 1 comprising the steps of:

manufacturing molten metal by adding C, Si, Mn, P, S, Cu, Mg, Nb, Fe and Al such that a sol. Al content in the molten metal is 0.01% or more;

forming a Ti nitride in the molten metal such that Ti is added to and dissolved in the molten metal where the sol. Al content is 0.01% or more, and thereafter that N is added to the molten metal; and manufacturing a nickel material having the chemical composition using the molten metal including the Ti nitride formed therein.

* * * * *